US009476593B2

(12) United States Patent
Marcakis

(10) Patent No.: US 9,476,593 B2
(45) Date of Patent: Oct. 25, 2016

(54) VARIABLE SECONDARY AIR INTAKE DEVICE

(71) Applicant: Emmanuel Marcakis, Montreal (CA)

(72) Inventor: Emmanuel Marcakis, Montreal (CA)

( * ) Notice: Subject to any disclaimer, the term of this patent is extended or adjusted under 35 U.S.C. 154(b) by 444 days.

(21) Appl. No.: 14/259,112

(22) Filed: Apr. 22, 2014

(65) Prior Publication Data

US 2015/0300649 A1 Oct. 22, 2015

(51) Int. Cl.

| | |
|---|---|
| ***F24B 5/00*** | (2006.01) |
| ***F24B 5/02*** | (2006.01) |
| ***F24B 1/02*** | (2006.01) |
| *F23M 9/06* | (2006.01) |

(52) U.S. Cl.

CPC ..... *F24B 5/025* (2013.01); *F24B 1/028* (2013.01); *F23M 9/06* (2013.01)

(58) Field of Classification Search

CPC ..... F24B 5/025; F24B 5/00; F24B 1/028; F23M 9/06

See application file for complete search history.

(56) References Cited

U.S. PATENT DOCUMENTS

| | | | | |
|---|---|---|---|---|
| 1,523,508 A | | 1/1925 | Bibb | |
| 2,350,830 A | | 6/1944 | Scheu | |
| 2,407,743 A | | 9/1946 | Helyar | |
| 2,793,811 A | * | 5/1957 | Coselman | G05D 23/08 236/10 |
| 3,168,088 A | * | 2/1965 | Martin | F24B 5/026 126/77 |
| 3,568,590 A | | 3/1971 | Grice | |
| 4,111,181 A | | 9/1978 | Canney | |
| 4,316,444 A | * | 2/1982 | Gullickson | F23B 5/02 126/112 |
| 4,338,913 A | * | 7/1982 | Good | F24B 5/025 126/197 |
| 4,362,146 A | * | 12/1982 | Schuller | F24B 1/02 126/163 A |
| 4,375,872 A | * | 3/1983 | Schrock | F23N 3/047 236/16 |
| 4,385,620 A | * | 5/1983 | Black | F24B 7/025 126/290 |
| 4,409,956 A | | 10/1983 | Barnett | |
| 4,461,275 A | * | 7/1984 | Lucas | F23L 3/00 126/286 |
| 4,543,941 A | * | 10/1985 | Newell | F23L 3/00 126/293 |
| 4,580,546 A | | 4/1986 | Barnett | |
| 5,357,941 A | | 10/1994 | Duerichen et al. | |
| 6,041,770 A | | 3/2000 | Erickson | |
| 6,546,926 B1 | | 4/2003 | Perrault | |
| 6,817,354 B2 | | 11/2004 | Laitinen et al. | |
| 7,874,287 B1 | * | 1/2011 | Freden | F23L 1/00 110/182 |

FOREIGN PATENT DOCUMENTS

| | | |
|---|---|---|
| WO | WO9416271 | 7/1994 |

* cited by examiner

*Primary Examiner* — Christopher Harmon

(57) ABSTRACT

A variable secondary air intake device has a baffle member adapted to be attached within an upper area of a fire chamber of the firebox. The baffle member includes a top having a channel member hole therethrough, side walls, a bottom having a plurality of small holes therethrough, and a gas exit opening having side walls and extending through the top and bottom. A hollow chamber member adapted to be placed upon a top surface of the baffle member, the hollow chamber member includes a top having a channel member hole therethrough, and side walls extending downward from the top and forming a chamber having a periphery that includes a plurality of gas exit holes therethrough.

12 Claims, 5 Drawing Sheets

VARIABLE SECONDARY AIR INTAKE DEVICE

This application claims priority based on request GB1307428.1 filed Apr. 24, 2013

FIELD OF THE INVENTION

The present invention relates generally to solid fuel burning appliances but more particularly to an variable secondary air intake device.

BACKGROUND OF THE INVENTION

Solid fuel burning appliances have two sources of air. A primary source and a secondary source. The primary source controls the burn rate and is arranged in such a way that the air is in contact with the wood and helps the wood to burn as a solid. It is adjustable by the user.

The secondary source is not in direct contact with the wood. It is directed into the firebox, usually from the top part, just below the baffle. It helps to burn the combustible gases before escaping to the chimney. If those gases are not burned properly, they are a source of pollution but also are wasted as a potential source of additional heat energy.

Currently, in wood burning appliances, the secondary air is constant and cannot be adjusted. The amount of secondary air required for proper combustion varies with the amount of gas released in relation to the temperature of the firebox, and as such, ideally, a variable amount of secondary source air is best.

SUMMARY OF THE INVENTION

In view of the foregoing disadvantages inherent in the known devices now present in the prior art, the present invention, which will be described subsequently in greater detail, is to provide objects and advantages which are:

To provide for a secondary source of air that is variable, which increases the efficiency of the appliance and maximizes its burn time.

In order to do so, the invention comprises a baffle member adapted to be attached within an upper area of a fire chamber of the firebox. The baffle member includes a top having a channel member hole therethrough, side walls, a bottom having a plurality of small holes therethrough, and a gas exit opening having side walls and extending through the top and bottom.

A hollow chamber member adapted to be placed upon a top surface of the baffle member, the hollow chamber member includes a top having a channel member hole therethrough, and side walls extending downward from the top and forming a chamber having a periphery that includes a plurality of gas exit holes therethrough.

An elongated hollow channel member adapted to be placed within and through the holes of the baffle member top, the hollow chamber member top, and a hole within a top member of the firebox, to thereby allow secondary air to pass therethrough and into the baffle member, and an adjustable gate adapted to be attached upon a top end portion of the channel member, the adjustable gate including a base portion having an opening therethrough adapted to allow the secondary air to pass therethrough and into the channel member.

The bimetal element begins to bend and push and pivot the cover member and thereby gradually open the opening and allow an increasing amount of secondary air to pass therethrough and into the baffle member to thereby pass through the plurality of small holes in the bottom thereof and into the fire chamber of the firebox as a secondary air supply to thereby increase the burning rate of the material being burned therein, and wherein flammable gases from the material being burned are adapted to rise and pass through the gas exit opening of the baffle member and into the hollow chamber of the hollow chamber member where they are slowed down and spread to thereby allow for their complete combustion before escaping through its gas exit holes and then out through an exhaust hole within a top member of the firebox and discharged through an exhaust pipe therefrom.

The bimetal element comprises two differing elongated flat metallic members connected to one another along adjacent surfaces.

The cover member of the adjustable gate is formed as an elongated rectangular channel having two sides extending perpendicular to a base portion, wherein the bimetal element resides within the channel, is parallel to the two sides, and is adapted to push against either side of the channel depending on the temperature of the fire chamber, such that when the temperature of the fire chamber is increasing, the cover member is gradually pushed and pivoted to an open position to allow more secondary air therethrough, and when the temperature of the fire chamber is decreasing, the cover member is gradually pushed and pivoted to a closed position to decrease and eventually cut off the amount of secondary air passing therethrough.

In a preferred embodiment, the hollow chamber forms an interior shape having a rectangular volume.

The baffle member is formed in the shape of a rectangular volume, the gas exit opening is formed in the shape of a rectangular volume, and the small holes being arranged into a series of concentric circles.

The channel member hole of the baffle member, the channel member hole of the hollow chamber member, and the channel member are formed having a similar rectangular cross section, and are aligned such that the channel member can pass snugly therethrough.

The variable secondary air intake device works in combination with a firebox.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
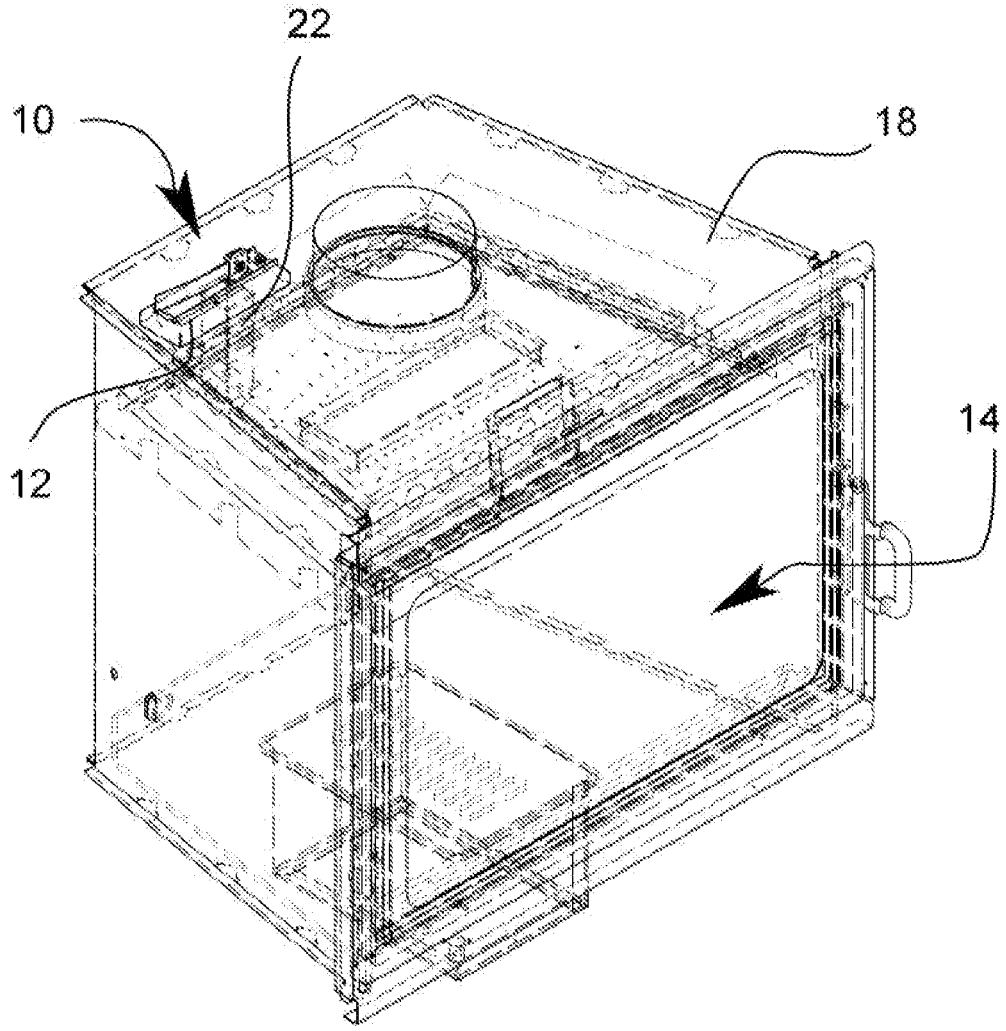
FIG. 1 Isometric view of the invention in context.
Figure 2:
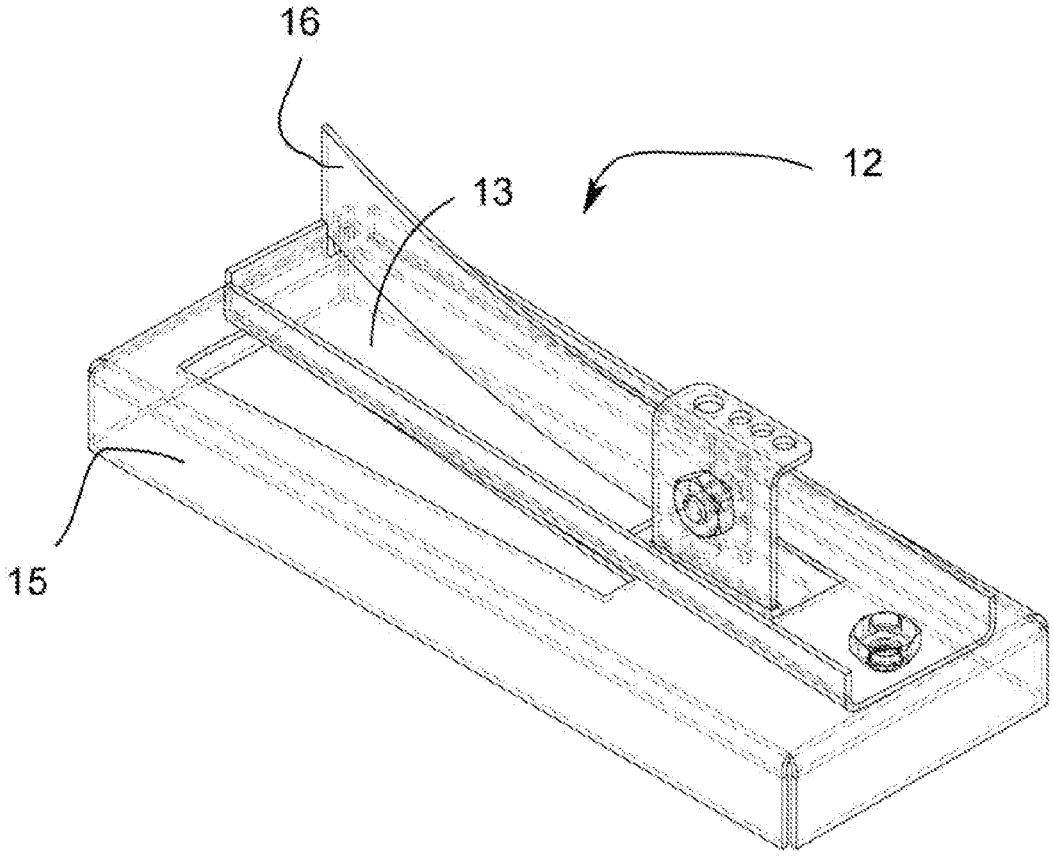
FIG. 2 Isometric view of the gate and opening.
Figure 3:
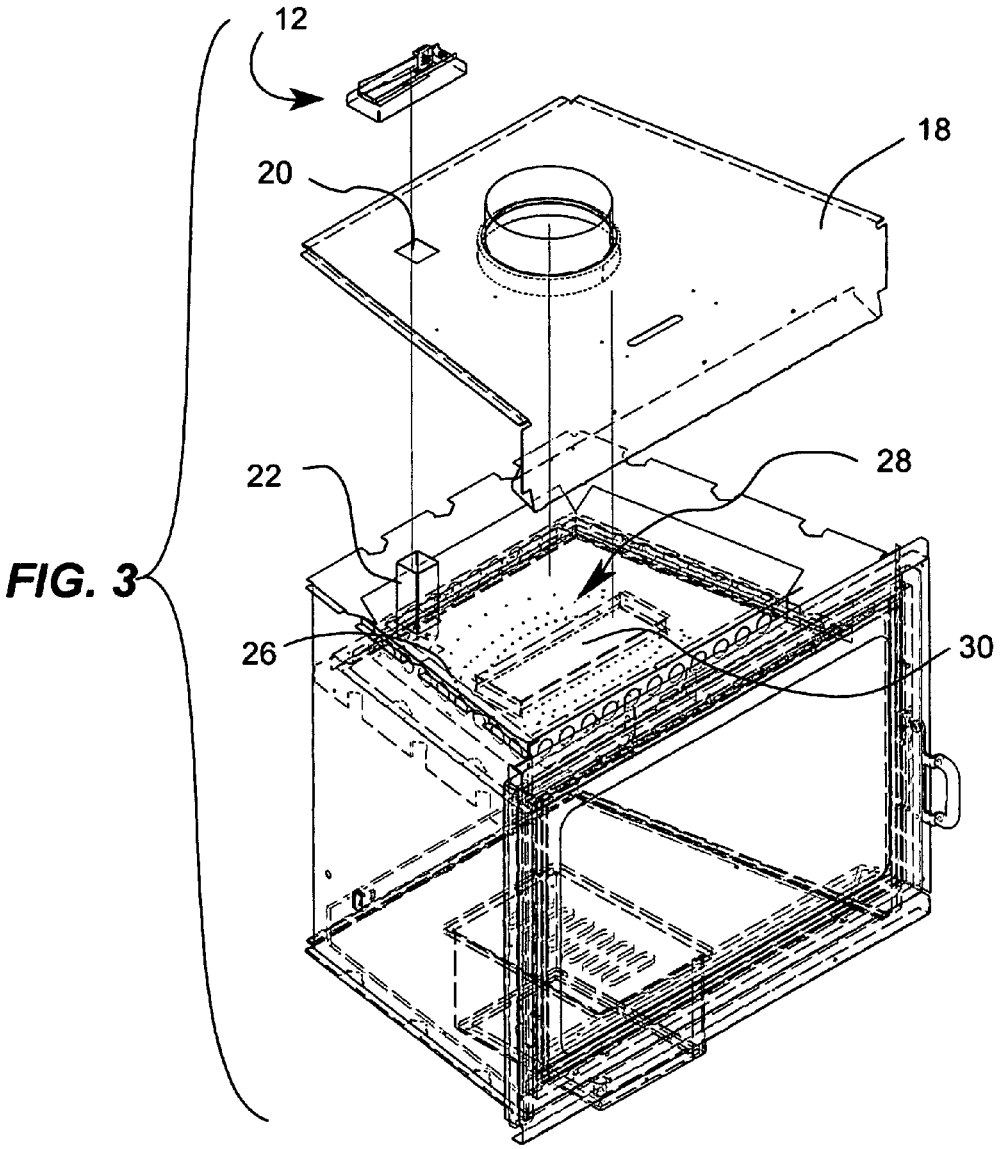
FIG. 3 Exploded view of the invention.
Figure 4A:
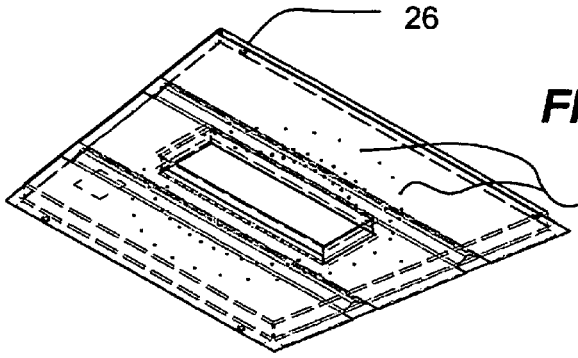
FIG. 4*a-d* Isometric, front, side cutaway, and top view, respectively, of the baffle.
Figure 4B:
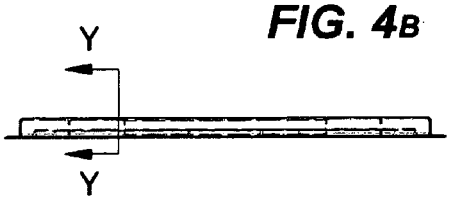
Figure 4C:
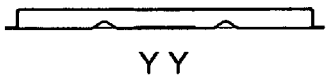
Figure 4D:
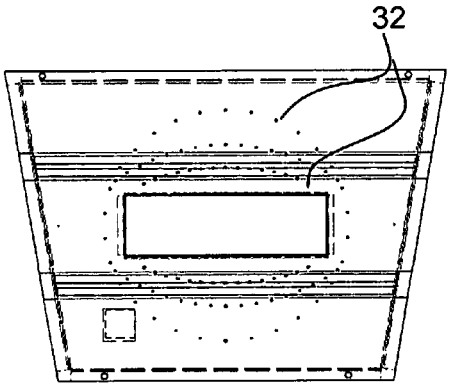
Figure 5A:
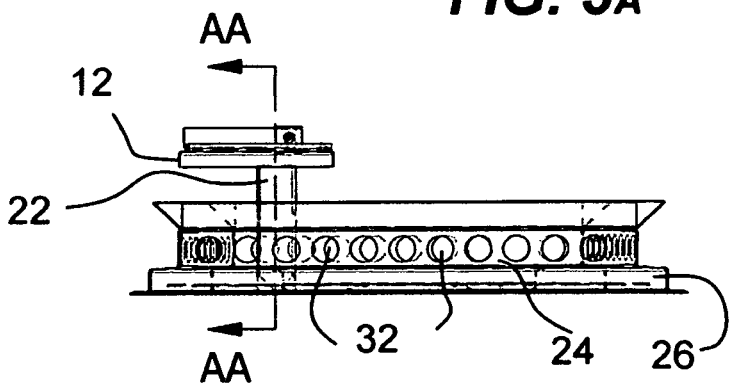
FIGS. 5*a-b* Side and front cutaway view respectively, of the hollow chamber.
Figure 5B:
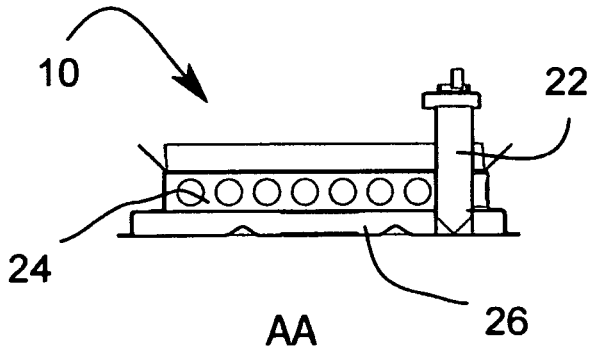

A variable secondary air intake device (10) is comprised of an adjustable gate (12) covering an opening (20), a channel member (22), and a baffle member (26).

The gate (12) varies the amount of secondary air entering a fire chamber (14) by way of the channel member (22). The gate (12) is comprised of a cover member (13), and a base portion (15). The gate (12) is controlled by a bimetal element (16) which pushes the gate (12) open as the increasing amount of heat bends the bimetal into pushing the gate (12) open or closing it as the amount of heat decreases.

The top part of a firebox (18) has the secondary air entering from the opening (20), through the channel member (22), and into the baffle member (26) where the secondary air is preheated before entering the fire chamber (14) through a plurality of small holes (28).

When the fire is started, only primary air enters the fire chamber (14). At this stage there is no need for secondary air since the mass of wood is cold and there aren't any flammable gases released. As the burning progresses, the temperature rises and flammable gases are released, the bimetal element (16) starts opening the adjustable gate (12) gradually, allowing secondary air to enter the fire chamber (14), as described hereinabove, and complete the combustion.

The products of combustion (gases) enter a hollow chamber member (24), located just above the baffle member (26), through a gas exit opening (30). In this hollow chamber (24), the gases are slowed down and spread to allow for a complete combustion before the gases escape through gas exit holes (32) located on the periphery of the hollow chamber member (24). The exit holes (32) connect with a chimney (not shown) as is known in the art.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A variable secondary air intake device for use with a firebox, said variable secondary air intake device comprising of a baffle member adapted to be attached within an upper area of a fire chamber of said firebox, said baffle member including a top having a channel member hole therethrough, side walls, a bottom having a plurality of small holes therethrough, and a gas exit opening having side walls and extending through said top and bottom; a hollow chamber member adapted to be placed upon a top surface of said baffle member, said hollow chamber member including a top having a channel member hole therethrough, and side walls extending downward from said top and forming a chamber having a periphery that includes a plurality of gas exit holes therethrough; an elongated hollow channel member adapted to be placed within and through said holes of said baffle member top, said hollow chamber member top, and a hole within a top member of said firebox, to thereby allow secondary air to pass therethrough and into said baffle member, and an adjustable gate adapted to be attached upon a top end portion of said channel member, said adjustable gate including a base portion having an opening therethrough adapted to allow said secondary air to pass therethrough and into said channel member, a movable cover member pivotally attached to said base portion and adapted to adjustably cover said opening, and a bimetal element attached to said base portion and adapted to push against and move said cover member in either of two pivoting directions depending on the temperature of said bimetal element, wherein said adjustable secondary air intake device is adapted such that when a fire rises above a predetermined temperature within said firebox chamber, said bimetal element begins to bend and push and pivot said cover member and thereby gradually open said opening and allow an increasing amount of secondary air to pass therethrough and into said baffle member to thereby pass through said plurality of small holes in said bottom thereof and into said fire chamber of said firebox as a secondary air supply to thereby increase the burning rate of the material being burned therein, and wherein flammable gases from said material being burned are adapted to rise and pass through said gas exit opening of said baffle member and into the hollow chamber of said hollow chamber member where they are slowed down and spread to thereby allow for their complete combustion before escaping through its gas exit holes and then out through an exhaust hole within a top member of said firebox and discharged through an exhaust pipe therefrom.

2. The variable device of claim 1, wherein said bimetal element comprises two differing elongated flat metallic members connected to one another along adjacent surfaces.

3. The variable device of claim 2, wherein said cover member of said adjustable gate is formed as an elongated rectangular channel having two sides extending perpendicular to a base portion, wherein said bimetal element resides within said channel, is parallel to said two sides, and is adapted to push against either side of said channel depending on the temperature of said fire chamber, such that when the temperature of said fire chamber is increasing, said cover member is gradually pushed and pivoted to an open position to allow more secondary air therethrough, and when the temperature of said fire chamber is decreasing, said cover member is gradually pushed and pivoted to a closed position to decrease and eventually cut off the amount of secondary air passing therethrough.

4. The variable device of claim 1, wherein said hollow chamber forms an interior shape having a rectangular volume.

5. The variable device of claim 1, wherein said baffle member is formed in the shape of a rectangular volume, said gas exit opening is formed in the shape of a rectangular volume, and said small holes being arranged into a series of concentric circles.

6. The variable device of claim 1, wherein said channel member hole of said baffle member, said channel member hole of said hollow chamber member, and said channel member are formed having a similar rectangular cross section, and are aligned such that said channel member can pass snugly therethrough.

7. A combination of a firebox and a variable secondary air intake device, said firebox including a fire chamber forming an interior rectangular volume; and a top member including a channel member hole therethrough, and an exhaust vent hole therethrough; and said adjustable secondary air intake device comprising of a baffle member adapted to be attached within an upper area of said fire chamber of said firebox, said baffle member including a top having a channel member hole therethrough, side walls, a bottom having a plurality of small holes therethrough, and a gas exit opening having side walls and extending through said top and bottom; a hollow chamber member adapted to be placed upon a top surface of said baffle member, said hollow chamber member including a top having a channel member hole therethrough, and side walls extending downward from said top and forming a chamber having a periphery that includes a plurality of gas exit holes therethrough; an elongated hollow channel member adapted to be placed within and through said holes of said baffle member top, said hollow chamber member top, and a hole within a top member of said firebox, to thereby allow secondary air to pass therethrough and into said baffle member, and an adjustable gate adapted to be attached upon a top surface of said top member of said firebox and to a top end portion of said channel member, said adjustable gate including a base portion having an opening therethrough adapted to allow said secondary air to pass therethrough and into said channel member, a movable cover member pivotally attached to said base portion and adapted to adjustably cover said opening, and a bimetal element attached to said base portion and adapted to push against and move said cover member in either of two pivoting directions depending on the temperature of said bimetal element, wherein said adjustable secondary air intake device is adapted such that when a fire rises above a predetermined temperature within said firebox chamber, said bimetal element begins to bend and push and pivot said cover member and thereby gradually open said opening and allow an increasing amount of secondary air to pass therethrough and into said baffle member to thereby pass through said plurality of small holes in said bottom thereof and into said fire chamber of said firebox as a secondary air supply to thereby increase the burning rate of the material being burned therein, and wherein flammable gases from said material being burned are adapted to rise and pass through said gas exit opening of said baffle member and into the hollow chamber of said hollow chamber member where they are slowed down and spread to thereby allow for their complete combustion before escaping through its gas exit holes and then out through said exhaust hole of said top member of said firebox and discharged through an exhaust pipe therefrom.

8. The adjustable device of claim 7, wherein said bimetal element comprises two differing elongated flat metallic members connected to one another along adjacent surfaces.

9. The adjustable device of claim 8, wherein said cover member of said adjustable gate is formed as an elongated rectangular channel having two sides extending perpendicular to a base portion, wherein said bimetal element resides within said channel, is parallel to said two sides, and is adapted to push against either side of said channel depending on the temperature of said fire chamber, such that when the temperature of said fire chamber is increasing, said cover member is gradually pushed and pivoted to an open position to allow more secondary air therethrough, and when the temperature of said fire chamber is decreasing, said cover member is gradually pushed and pivoted to a closed position to decrease and eventually cut off the amount of secondary air passing therethrough.

10. The adjustable device of claim 7, wherein said hollow chamber forms an interior shape having a rectangular volume.

11. The adjustable device of claim 7, wherein said baffle member is formed in the shape of a rectangular volume, said gas exit opening is formed in the shape of a rectangular volume, and said small holes being arranged into a series of concentric circles.

12. The adjustable device of claim 7, wherein said channel member hole of said top member of said firebox, said channel member hole of said baffle member, said channel member hole of said hollow chamber member, and said channel member are formed having a similar rectangular cross section, and are aligned such that said channel member can pass snugly therethrough.

* * * * *